US010183196B2

(12) United States Patent
Sato

(10) Patent No.: US 10,183,196 B2
(45) Date of Patent: Jan. 22, 2019

(54) GOLF BALL

(71) Applicant: BRIDGESTONE SPORTS CO., LTD., Tokyo (JP)

(72) Inventor: Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 15/188,026

(22) Filed: Jun. 21, 2016

(65) Prior Publication Data

US 2016/0375311 A1 Dec. 29, 2016

(30) Foreign Application Priority Data

Jun. 25, 2015 (JP) ..... 2015-127995

(51) Int. Cl.
*A63B 37/00* (2006.01)

(52) U.S. Cl.
CPC ..... *A63B 37/0012* (2013.01); *A63B 37/0077* (2013.01); *A63B 37/0087* (2013.01); *A63B 37/0006* (2013.01); *A63B 37/0007* (2013.01); *A63B 37/008* (2013.01); *A63B 37/0009* (2013.01); *A63B 37/0019* (2013.01); *A63B 37/0021* (2013.01); *A63B 37/0051* (2013.01); *A63B 37/0058* (2013.01); *A63B 37/0074* (2013.01); *A63B 37/0075* (2013.01); *A63B 37/0096* (2013.01)

(58) Field of Classification Search
CPC ..... A63B 37/0015; A63B 37/0004; A63B 37/0003; A63B 37/0012; A63B 37/0087; A63B 37/0005; A63B 2037/0079
See application file for complete search history.

(56) References Cited

U.S. PATENT DOCUMENTS 5,005,838 A * 4/1991 Oka ..... A63B 37/0004 40/327
5,536,013 A * 7/1996 Pocklington ..... A63B 37/0004 473/384
5,916,044 A * 6/1999 Shimosaka ..... A63B 37/0004 473/377

(Continued)

FOREIGN PATENT DOCUMENTS

JP 2004-201787 A 7/2004
JP 2005-6755 A 1/2005

(Continued)

OTHER PUBLICATIONS

Compressions by any other name—J. Dalton.*

*Primary Examiner* — John E Simms, Jr.
(74) *Attorney, Agent, or Firm* — Sughrue Mion, PLLC

(57) ABSTRACT

A golf ball includes a plurality of dimples on the surface thereof and satisfies the following expression (1):

$$PS_7/S/H\times100\geq6.25\ (\mathrm{mm}^{-1}) \quad (1),$$

wherein H is a deformation amount, which is expressed by a compressive deformation amount of the golf ball; S is a virtual plane area, which is a surface area of the golf ball determined supposing that no dimple exists on the surface of the golf ball; and $PS_7$ is a pressurized area, which is an area of the golf ball contacting a plane when a load of 6864 N is applied to the golf ball. The bottom of the dimple includes a center protruding portion with a curved shape protruding toward an outside of the golf ball.

18 Claims, 6 Drawing Sheets

(56) References Cited

U.S. PATENT DOCUMENTS

| | | | | | |
|---|---|---|---|---|---|
| 6,139,448 | A * | 10/2000 | Sullivan | A63B 37/0004 | 473/377 |
| 2008/0004137 | A1 * | 1/2008 | Kasashima | A63B 37/0004 | 473/383 |
| 2008/0125250 | A1 * | 5/2008 | Lee | A63B 37/0004 | 473/383 |
| 2011/0136590 | A1 * | 6/2011 | Kim | A63B 37/0004 | 473/384 |

FOREIGN PATENT DOCUMENTS

| | | | | |
|---|---|---|---|---|
| JP | 2005006755 | * | 1/2005 | A63B 37/00 |
| JP | 2008-12300 | A | 1/2008 | |
| JP | 2011-120612 | A | 6/2011 | |

* cited by examiner

GOLF BALL

CROSS-REFERENCE TO RELATED APPLICATION

This Application claims priority from Japanese Patent Application No. 2015-127995 filed Jun. 25, 2015, which is incorporated herein by reference in its entirety.

BACKGROUND OF THE INVENTION

The present invention relates to a golf ball, and more specifically, relates to a golf ball with improved frictional force at the time it is hit.

It is well known that when a golf ball is hit, backspin is applied to the golf ball. If too much backspin is applied on a driver shot, the ball tends to pop up. Accordingly, in order to extend the flight distance, it is generally desired to reduce the amount of backspin. In contrast, on approach shots, the greater the amount of backspin, the easier it becomes to control the golf ball to stop at a point near the landing point. Accordingly, desired amounts of backspin are converse in driver shots and in approach shots. In addition, it is well known that the friction between the club and the ball is related to the amount of backspin.

For example, in JP 2004-201787 A, it is disclosed that the greater the loft angle of the club head, the greater the amount of backspin of the ball according to the magnitude of the frictional coefficient of the face surface. It is also disclosed therein that in contrast, for a head with a small loft angle, the greater the frictional coefficient of the face surface, the less the amount of backspin.

In order to extend the flight distance of golf balls, research has been conducted to improve the aerodynamic performance of golf balls by devising the shape of a large number of dimples formed on the surface of golf balls. For example, in JP 2005-006755 A, a configuration of a dimple is disclosed in which a protrusion is provided in the center of the bottom of a dimple so that the radius of curvature of the center protrusion satisfies a predetermined condition. In JP 2008-012300 A, a configuration of a dimple is disclosed in which a circular protrusion is provided around the center of the bottom of a dimple, the upper end surface of the protrusion is flat, and the height of the protrusion and the depth of a ring-like portion around the protrusion satisfy predetermined conditions. In JP 2011-120612 A, a configuration of a dimple is disclosed in which the sectional shape of a dimple is a wave-like curve including plural alternately arranged upward protrusions and downward protrusions.

SUMMARY OF THE INVENTION

An object of the present invention is to provide a golf ball with improved force of friction with a golf club and having a performance in which the amount of backspin is small on driver shots and the amount of backspin is large on approach shots.

In order to achieve the above-described object, according to an aspect of the present invention, a golf ball includes a plurality of dimples on a surface thereof and satisfies the following expression (1):

$$PS_7/S/H\times100\geq6.25\ (\mathrm{mm}^{-1}) \quad (1),$$

wherein a deformation amount H (mm) is an amount of deformation obtained when loads from an initial load of 98 N (10 kgf) to a final load of 1275 N (130 kgf) are applied to the golf ball; a virtual plane area S ($mm^2$) is an area of a circle of a cross section along a diameter of the golf ball determined supposing that no dimple exists on the surface of the golf ball; and a pressurized area $PS_7$ ($mm^2$) is an area of the golf ball contacting a plane when a load of 6864 N (700 kgf) is applied to the golf ball.

The golf ball may further satisfy the following expression (2):

$$PS_2/S/H\times100\geq1.85\ (\mathrm{mm}^{-1}) \quad (2),$$

wherein a pressurized area $PS_2$ ($mm^2$) is an area of the golf ball contacting a plane when a load of 1961 N (200 kgf) is applied to the golf ball.

The golf ball may further satisfy the following expression (3):

$$PS_6/S/H\times100\geq5.40\ (\mathrm{mm}^{-1}) \quad (3),$$

wherein a pressurized area $PS_6$ ($mm^2$) is an area of the golf ball contacting a plane when a load of 5883 N (600 kgf) is applied to the golf ball.

The golf ball may further satisfy the following expression (4):

$$PS_4/S/H\times100\geq3.30\ (\mathrm{mm}^{-1}) \quad (4),$$

wherein a pressurized area $PS_4$ ($mm^2$) is an area of the golf ball contacting a plane when a load of 3922 N (400 kgf) is applied to the golf ball.

The golf ball may further satisfy the following expression (5):

$$PS_8/S/H\times100\geq6.50\ (\mathrm{mm}^{-1}) \quad (5),$$

wherein a pressurized area $PS_8$ ($mm^2$) is an area of the golf ball contacting a plane when a load of 7845 N (800 kgf) is applied to the golf ball.

According to another aspect of the present invention, a golf ball includes a plurality of dimples on a surface thereof and satisfies the following expression (2):

$$PS_2/S/H\times100\geq1.85\ (\mathrm{mm}^{-1}) \quad (2),$$

wherein a deformation amount H (mm) is an amount of deformation obtained when loads from an initial load of 98 N to a final load of 1275 N are applied to the golf ball; a virtual plane area S ($mm^2$) is an area of a circle of a cross section along a diameter of the golf ball determined supposing that no dimple exists on the surface of the golf ball; and a pressurized area $PS_2$ ($mm^2$) is an area of the golf ball contacting a plane when a load of 1961 N is applied to the golf ball.

According to another aspect of the present invention, a golf ball includes a plurality of dimples on a surface thereof and satisfies the following expression (3):

$$PS_6/S/H\times100\geq5.40\ (\mathrm{mm}^{-1}) \quad (3),$$

wherein a deformation amount H (mm) is an amount of deformation obtained when loads from an initial load of 98 N to a final load of 1275 N are applied to the golf ball; a virtual plane area S ($mm^2$) is an area of a circle of a cross section along a diameter of the golf ball determined supposing that no dimple exists on the surface of the golf ball; and a pressurized area $PS_6$ ($mm^2$) is an area of the golf ball contacting a plane when a load of 5883 N is applied to the golf ball.

According to another aspect of the present invention, a golf ball includes a plurality of dimples on a surface thereof and satisfies the following expression (4):

$$PS_4/S/H\times100\geq3.30\ (\mathrm{mm}^{-1}) \quad (4),$$

Wherein a deformation amount H (mm) is an amount of deformation obtained when loads from an initial load of 98

N to a final load of 1275 N are applied to the golf ball; a virtual plane area S ($mm^2$) is an area of a circle of a cross section along a diameter of the golf ball determined supposing that no dimple exists on the surface of the golf ball; and a pressurized area $PS_4$ ($mm^2$) is an area of the golf ball contacting a plane when a load of 3922 N (400 kgf) is applied to the golf ball.

According to another aspect of the present invention, a golf ball includes a plurality of dimples on a surface thereof and satisfies the following expression (5):

$$PS_8/S/H\times100\geq6.50\ (mm^{-1}) \quad (5),$$

wherein a deformation amount H (mm) is an amount of deformation obtained when loads from an initial load of 98 N to a final load of 1275 N are applied to the golf ball; a virtual plane area S ($mm^2$) is an area of a circle of a cross section along a diameter of the golf ball determined supposing that no dimple exists on the surface of the golf ball; and a pressurized area $PS_8$ ($mm^2$) is an area of the golf ball contacting a plane when a load of 7845 N (800 kgf) is applied to the golf ball.

To satisfy at least one of expressions (1) to (5) mentioned above, the bottom of the dimple preferably has a curved shape protruding toward an outside of the golf ball in the center of the dimple so that the golf ball has a predetermined pressurized area. The portion with the protruding curved shape further has a flat shape in a center region thereof, and an outer edge portion of the flat region can include a configuration in which a corner portion has been chamfered.

According to the present invention, the golf ball includes a configuration in which the pressurized area of the golf ball when a load from a driver shot by an ordinary golfer satisfies the conditions represented by expression (1) mentioned above, and thereby the contact area between the golf ball and the golf club is increased and the friction with the golf club is improved, the amount of backspin applied on driver shots can be reduced, and as a result, the flying distance can be improved.

In addition, according to the present invention, the golf ball includes a configuration in which the pressurized area of the golf ball when a load from a driver shot by an ordinary golfer satisfies the conditions represented by expression (2) mentioned above, and thereby the contact area between the golf ball and the golf club is increased and the friction with the golf club is improved, the amount of backspin applied on approach shots can be increased, and as a result, the golf ball can be more immediately stopped near its landing point.

In addition, according to the present invention, the golf ball includes a configuration in which the pressurized area of the golf ball when a load from a shot by a golfer with high head speed given by using a middle iron satisfies the conditions represented by expression (3) mentioned above, and thereby the contact area between the golf ball and the golf club is increased and the friction with the golf club is improved, the amount of backspin applied on shots can be reduced, and as a result, the flying distance can be improved.

In addition, according to the present invention, the golf ball includes a configuration in which the pressurized area of the golf ball when a load from a shot by an ordinary golfer given by using a middle iron satisfies the conditions represented by expression (4) mentioned above, and thereby the contact area between the golf ball and the golf club is increased and the friction with the golf club is improved, the amount of backspin applied on shots can be reduced, and as a result, the flight distance can be improved.

In addition, according to the present invention, the golf ball includes a configuration in which the pressurized area of the golf ball when a load from a shot by a golfer with high head speed given by using a middle iron satisfies the conditions represented by expression (5) mentioned above, and thereby the contact area between the golf ball and the golf club is increased and the friction with the golf club is improved, the amount of backspin applied on shots can be reduced, and as a result, the flying distance can be improved.

To satisfy at least one of the conditions represented by expressions (1) to (5) mentioned above, by shaping the dimple so that the bottom of the dimple has a predetermined curved shape protruding toward an outside of the golf ball in the center of the dimple, the predetermined pressurized area can be obtained without impairing the original aerodynamic performance of the dimple. Further, the shape of the portion with the protruding curved shape can be flat in a center region thereof. In this configuration, an outer edge portion of the flat region can include a configuration in which a corner portion has been chamfered, and thereby the contact area at the time of hitting of the ball can be effectively increased.

DETAILED DESCRIPTION OF THE PREFERRED EMBODIMENT

Figure 1:
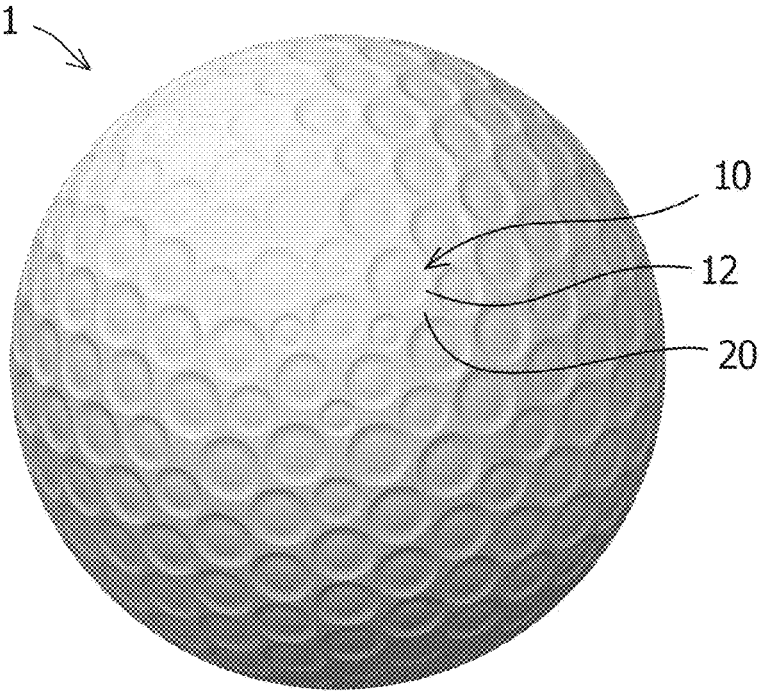
FIG. 1 is a perspective view which illustrates an embodiment of a golf ball according to the present invention.

An embodiment of a golf ball according to the present invention will be described below with reference to attached drawings. However, the present invention is not limited thereby.

In the golf ball according to the present invention, according to an embodiment thereof, a relationship among the deformation amount H (mm) of the golf ball, the virtual plane area S ($mm^2$) of the golf ball, and the pressurized area $PS_7$ ($mm^2$) of the golf ball satisfies the following expression (1):

$$PS_7/S/H\times100\geq6.25\ (mm^{-1}) \quad (1),$$

The deformation amount H of the golf ball is an amount of deformation (compressive deformation amount) of the golf ball when loads from the initial load of 98 N to the final load of 1275 N are applied to the golf ball. The unit is expressed in "mm". The measurement temperature is 23°

C.±1, and the rate of compression is 10 mm/s. Usually, an average value is determined on the basis of measurement for 10 golf balls. For this deformation amount, the smaller the numerical value thereof, the harder the golf ball becomes, and the greater the numerical value thereof, the softer the golf ball becomes. In addition, the deformation amount influences the hitting feeling felt by the golfer when the golfer takes a shot, the durability, and the like. Accordingly, it is preferable that a lower limit of the deformation amount be 1.5 mm or more and an upper limit thereof be 5.0 mm or less.

Note that in producing a golf ball having the deformation amount (ball hardness) described above, the structure thereof is not particularly limited, and a two-piece structure including a core and a cover can be employed, and also a multi-piece structure such as a three-piece structure including an intermediate layer arranged between a core and a cover can be employed. The core can be formed primarily from base material rubber. For the base material rubber, a wide variety of rubbers can be employed. Examples of the rubber that can be used include, not are but limited to, polybutadiene rubber (BR), styrene-butadiene rubber (SBR), natural rubber (NR), polyisoprene rubber (IR), polyurethane rubber (PU), and silicone rubber.

In addition to the base material rubber that is the main component, optional components such as co-crosslinking agent, crosslinking agent, filler, anti-aging agent, isomerization agent, peptizer, sulfur, and organosulfur compound can be added to the core. As the main component, instead of the base material rubber, a thermoplastic elastomer, an ionomer resin, or a mixture thereof can be used.

The material of the cover is not particularly limited, and the cover can be formed by using a material that uses, but is not limited to, an ionomer resin, a polyurethane thermoplastic elastomer, thermosetting polyurethane, and a mixture thereof as the main component. In addition to the main component described above, other thermoplastic elastomers, a polyisocyanate compound, fatty acid or a derivative thereof, a basic inorganic metal compound, a filler, and the like can be added to the cover.

For the intermediate layer, an intermediate layer having a core-like function may be formed by using the same material as that of the core described above, and alternatively, an intermediate layer having a cover-like function may be formed by using the same material as that of the cover described above. In a further alternative configuration, a plurality of intermediate layers may be provided. In this configuration, for example, a first intermediate layer having a core-like function and a second intermediate layer having a cover-like function may be provided.

The virtual plane area S of the golf ball refers to an area of a circle of a cross section along a diameter of the golf ball, which is a virtual plane area determined supposing that no dimple exists on the surface of the golf ball. Accordingly, the virtual plane area is determined on the basis of the diameter of the golf ball. The diameter of the golf ball is determined by the official regulations, which is usually 42.6 to 42.8 mm. The unit of the virtual plane area is expressed in "$mm^2$".

The pressurized area $PS_7$ of the golf ball refers to an area of the golf ball contacting a plane when a load of 6864 N is applied to the golf ball on which predetermined dimples are arranged. Note that if the load of 1961 N is applied, the pressurized area is referred to as the "pressurized area $PS_2$", if the load of 5883 N is applied, the pressurized area is referred to as the "pressurized area $PS_6$", if the load of 3922 N is applied, the pressurized area is referred to as the "pressurized area $PS_4$", and if the load of 7845 N is applied, the pressurized area is referred to as the "pressurized area $PS_8$". The unit of the pressurized area is expressed in "$mm^2$". Needless to say, the pressurized area is changed by the magnitude of the load applied to the ball, and is also greatly influenced by the shape and the arrangement of the dimples as will be described in detail below. In addition, as will be described below with reference to an example of measurement of the pressurized area, the pressurized area may be determined on the basis of results of measurement at one freely selected location on the golf ball. In other words, the expression mentioned above may be satisfied only at one location on the golf ball.

The pressurized area PS of the golf ball expresses the contact area of the golf ball with the golf club when a predetermined shot is taken, and in the present invention, the contact area is larger than that of the prior art by devising the structure of the dimples. The pressurized area PS is dependent on the size of the golf ball, and specifically, as the size of the golf ball increases, the pressurized area PS becomes higher, whereas as the size of the golf ball decreases, the pressurized area PS becomes lower. Accordingly, by dividing the pressurized area PS by the virtual plane area S and thus obtaining and using a percentage value, the increase of the contact area obtained due to the structure of the dimples can be evaluated regardless of the size of the golf ball. In addition, the above-described pressurized area PS is dependent on the deformation amount H of the golf ball. Specifically, as the deformation amount H increases, the pressurized area PS increases while as the deformation amount H decreases, the pressurized area PS decreases. Accordingly, by further dividing the pressurized area PS by the deformation amount H, the increase of the contact area obtained due to the structure of the dimples can be evaluated also regardless of the deformation amount of the golf ball.

Expression (1) mentioned above is an expression used for an example in which the load of 6864 N, which is a load applied by driver shot by an ordinary golfer, is applied to the golf ball. By increasing the value obtained from expression (1) compared with that of the prior art so that it becomes 6.25 $mm^{-1}$, the contact area between the golf ball and the golf club is optimized, and as a result, the amount of backspin on driver shots can be reduced.

It is more preferable that the relationship among the deformation amount H, the virtual plane area S, and the pressurized area $PS_7$ satisfy the following expression (1a), and it is yet more preferable that the relationship satisfy the following expression (1b):

$$PS_7/S/H\times100\geq6.80\ (mm^{-1}) \quad (1a)$$

$$PS_7/S/H\times100\geq7.20\ (mm^{-1}) \quad (1b).$$

The golf ball of the present invention, as an embodiment thereof, satisfies the following expression (2) separately from and in addition to expression (1) mentioned above:

$$PS_2/S/H\times100\geq1.85\ (mm^{-1}) \quad (2),$$

It is more preferable that the relationship among the deformation amount H, the virtual plane area S, and the pressurized area $PS_2$ satisfy the following expression (2a), and it is yet more preferable that the relationship satisfy the following expression (2b):

$$PS_2/S/H\times100\geq2.00\ (mm^{-1}) \quad (2a),$$

$$PS_2/S/H\times100\geq2.10\ (mm^{-1}) \quad (2b),$$

In addition, the golf ball of the present invention, as an embodiment thereof, satisfies the following expression (3) separately from and in addition to expressions (1) and (2) mentioned above:

$$PS_6/S/H\times100\geq5.40\ (mm^{-1}) \quad (3),$$

It is more preferable that the relationship among the deformation amount H, the virtual plane area S, and the pressurized area $PS_6$ satisfy the following expression (3a), and it is yet more preferable that the relationship satisfy the following expression (3b):

$$PS_6/S/H\times100\geq5.90\ (\mathrm{mm}^{-1}) \quad (3a),$$

$$PS_6/S/H\times100\geq6.40\ (\mathrm{mm}^{-1}) \quad (3b),$$

In addition, the golf ball of the present invention, as an embodiment thereof, satisfies the following expression (4) separately from and in addition to expressions (1) to (3) mentioned above:

$$PS_4/S/H\times100\geq3.30\ (\mathrm{mm}^{-1}) \quad (4),$$

It is more preferable that the relationship among the deformation amount H, the virtual plane area S, and the pressurized area $PS_4$ satisfy the following expression (4a), and it is yet more preferable that the relationship satisfy the following expression (4b):

$$PS_4/S/H\times100\geq3.80\ (\mathrm{mm}^{-1}) \quad (4a),$$

$$PS_4/S/H\times100\geq4.00\ (\mathrm{mm}^{-1}) \quad (4b),$$

In addition, the golf ball of the present invention, as an embodiment thereof, satisfies the following expression (5) separately from and in addition to expressions (1) to (4) mentioned above:

$$PS_4/S/H\times100\geq6.50\ (\mathrm{mm}^{-1}) \quad (5),$$

It is more preferable that the relationship among the deformation amount H, the virtual plane area S, and the pressurized area $PS_8$ satisfy the following expression (5a), and it is yet more preferable that the relationship satisfy the following expression (5b):

$$PS_8/S/H\times100\geq7.20\ (\mathrm{mm}^{-1}) \quad (5a),$$

$$PS_8/S/H\times100\geq8.00\ (\mathrm{mm}^{-1}) \quad (5b),$$

Next, an embodiment of the configuration of the golf ball that can satisfy at least one of expressions (1), (2), (3), (4), and (5) mentioned above will be described below with reference to FIGS. 1 to 4. However, the present invention is not limited to the following embodiments. For example, instead of arranging two or more protrusions described below and arranging the peak of the protrusion in their center, the peak may be arranged at a location set off from the center in the left-right direction. That is, it is only necessary that the configuration satisfies the expressions mentioned above.

Figure 2:
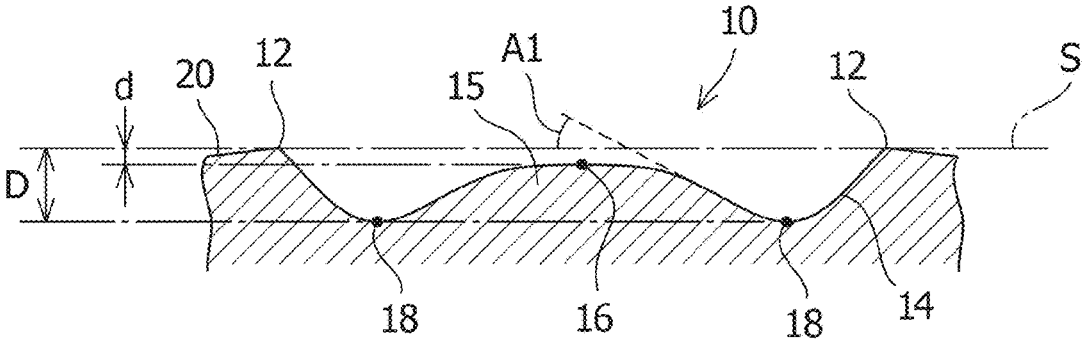
FIG. 2 is an enlarged cross-sectional view of one dimple of the golf ball illustrated in FIG. 1.

As shown in FIGS. 1 and 2, on the surface of a golf ball 1 of the present embodiment, a plurality of dimples 10 is formed. A portion of the surface of the golf ball 1 located among the plurality of dimples 10 is usually referred to as a land portion 20. The land portion 20 constitutes the spherical surface of the golf ball 1. Accordingly, the land portion 20 has a surface curvature.

Figure 9:
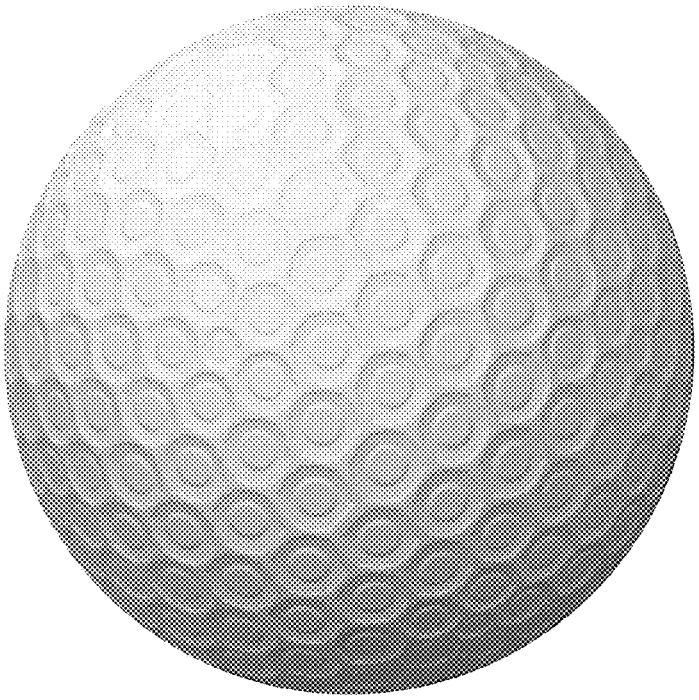
FIG. 9 is a perspective view which illustrates yet another embodiment of the golf ball according to the present invention.

The planar shape of the dimple 10 formed on the surface of the golf ball 1 (i.e., the shape recognized when an outer periphery 12 of the dimple 10 or a boundary between the dimple 10 and the land portion 20 is viewed from immediately above the dimple) may be circular, polygonal, noncircular, and the like. In the present embodiment, the planar shape is circular. In this circular shape configuration, the diameter of the golf ball is preferably in a range of 2 to 5 mm. FIG. 9 illustrates an example of a configuration in which the planar shape of the dimple is noncircular. The dimple illustrated in FIG. 9 has a planar shape including a combination of a plurality of curved portions (the number of the curved portions is 12 in the drawing) protruding toward an inside of the dimple.

In addition, the dimple 10 of the present embodiment has a shape in which a part of the bottom thereof is curved so as to protrude toward an outside of the ball. FIG. 2 illustrates a cross section of the dimple 10 along the diameter thereof. As shown in FIG. 2, the dimple 10 has a bottom 14 with a curved shape shaped from one end to the other end of the outer periphery 12. The bottom 14 includes a portion with a curved shape protruding toward the outside of the ball, i.e., a center protruding portion 15, and a portion with a curved shape recessed from the outside of the ball arranged in a ring-like region in its outer periphery.

The bottom 14 is curved so that the depth thereof becomes the deepest at a deepest point 18 located on both sides of the center protruding portion 15. The location of the deepest point 18 on the plane is preferably in a range of 20 to 45, more preferably in a range of 25 to 40, yet more preferably in a range of 30 to 35, in relation to the distance from the outer periphery 12 to a center point 16 of the dimple as 100.

A depth d of the center protruding portion 15 of the dimple 10 is a perpendicular distance from the height of a line S connecting both ends of the outer periphery 12 of the dimple as the reference to the highest point of the center protruding portion 15 (the center point 16). For the depth d of the center protruding portion 15, to obtain a predetermined pressurized area, a lower limit thereof is preferably 0.020 mm or more, more preferably 0.025 mm or more, for example, although it differs according to the diameter of the dimple. An upper limit thereof is preferably 0.100 mm or less, more preferably 0.080 mm or less.

A depth D of the dimple 10 is a perpendicular distance from the height of the line S connecting both ends of the outer periphery 12 of the outer periphery 12 as a reference to the deepest point 18 of the bottom 14 of the dimple. The depth D of the dimple 10 differs according to the depth d of the center protruding portion 15. For example, the depth D of the dimple 10 is deeper than the depth d of the center protruding portion 15 preferably by 0.050 mm or more, more preferably by 0.100 mm or more. An upper limit of the depth D of the dimple 10 is not particularly limited, and is preferably 0.200 mm or less, more preferably 0.150 mm or less.

It is preferable that the shape of the bottom 14 of the dimple 10 be gently curved. For the curved shape of the dimple bottom 14, a lower limit of an edge angle A1 to the center protruding portion is preferably 2° or more, more preferably 3° or more. An upper limit of the edge angle A1 is preferably 15° or less, more preferably 11° or less. Note that the edge angle A1 is an angle formed between a tangent line passing through the depth d on the bottom curve and a point deeper than the depth d by 10% and the above-described line S.

Figure 3:
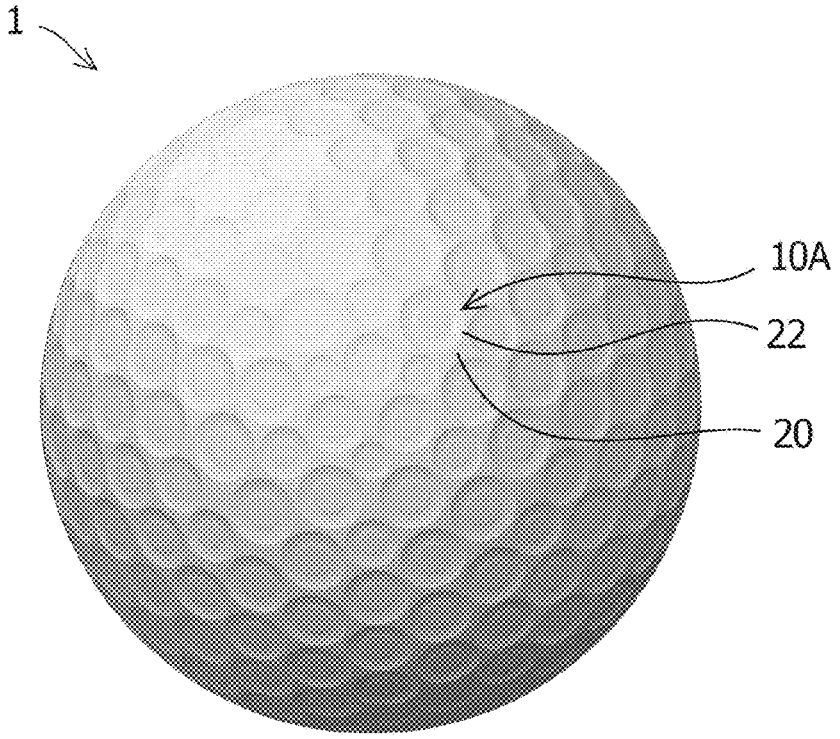
FIG. 3 is a perspective view which illustrates another embodiment of the golf ball according to the present invention.
Figure 4:
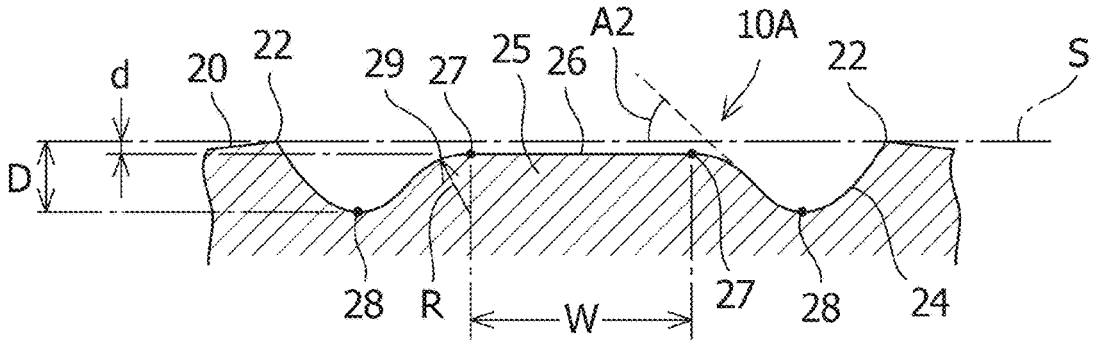
FIG. 4 is an enlarged cross-sectional view of one dimple of the golf ball illustrated in FIG. 3.

FIGS. 3 and 4 illustrate a golf ball according to another embodiment. On the surface of the golf ball 1 according to the present embodiment, a plurality of dimples 10A is formed. In the dimple 10A of the present embodiment, the bottom thereof has a curved shape protruding toward the outside of the ball in the center of the dimple as illustrated particularly in FIG. 4. However, differently from the example illustrated in FIG. 2, the bottom is not entirely curved and the leading edge portion has a planar shape.

To describe this configuration more specifically, a bottom 24 shaped from one end of an outer periphery 22 of the dimple 10A to the other end has a portion with a curved shape protruding toward the outside of the ball in a center region thereof and a flat shape in a further central portion thereof, i.e., a center protruding portion 25, and a portion with a curved shape recessed from the outside of the ball in a ring-like region in its outer periphery.

In the flat region of the center protruding portion 25, a distance W between both ends 27 is preferably in a range of 35 to 65, more preferably in a range of 40 to 60, and yet more preferably in a range of 45 to 55 in relation to a distance from the outer periphery 22 to a center point 26 of the dimple as 100.

An outer periphery 29 of the flat region of the center protruding portion 25 is configured so that a corner portion thereof is chamfered. With the configuration in which the corner portion is chamfered, the outer periphery 29 can effectively contribute to the increase of the contact area of the present invention, and as a result, the spin performance can be improved. The radius of curvature R is preferably 0.4 mm or more, more preferably 0.5 mm or more. An upper limit of the radius of curvature R is preferably 2.5 mm or less, more preferably 2.0 mm or less.

A depth d of the center protruding portion 25 in the flat region is constant. The depth d of the center protruding portion 25 is determined on the basis of the line S connecting both ends of the outer periphery 22 as the reference, as described above. For the depth d of the center protruding portion 25, to obtain a predetermined pressurized area, a lower limit thereof is preferably 0.020 mm or more, more preferably 0.030 mm or more, for example, although it differs according to the diameter of the dimple. An upper limit thereof is preferably 0.120 mm or less, more preferably 0.100 mm or less.

In regions on both sides of the center protruding portion 25, the bottom of the dimple is curved so that the depth thereof becomes the deepest at a deepest point 28. The location of the deepest point 28 on the plane is preferably in a range of 25 to 55, more preferably in a range of 30 to 50, yet more preferably in a range of 35 to 45, in relation to the distance from the outer periphery 22 to a center point 26 of the dimple as 100.

The depth D of the dimple 10A differs according to the depth d of the center protruding portion 25. For example, the depth D of the dimple 10 is deeper than the depth d of the center protruding portion 25 preferably by 0.025 mm or more, more preferably by 0.030 mm or more. An upper limit of the depth D of the dimple 10A is not particularly limited, and is preferably 0.200 mm or less, more preferably 0.150 mm or less.

For the curved shape of the bottom 24 of the dimple 10A, a lower limit of an edge angle A2 to the center protruding portion is preferably 2° or more, more preferably 3° or more. An upper limit of the edge angle A2 is preferably 15° or less, more preferably 11° or less. The edge angle A2 is an angle formed between a tangent line passing through the depth d on the bottom curve and a point deeper than the depth d by 10% and the above-described line S.

It is not necessary for all the dimples formed on the surface of the golf ball to have the center-protruding shape described above. Specifically, preferably 50% or more, more preferably 70% or more of all the dimples are provided with the center-protruding shape. Of course, all the dimples may be provided with the center-protruding shape. In order to exert excellent aerodynamic isotropy and air resistance, it is preferable that the dimples having the center-protruding shape described above be arranged uniformly for the entire golf ball surface.

Note that an upper limit of the number of the dimples is, not but limited to, preferably 500 or less, more preferably 450 or less. A lower limit of the number of the dimples is, but is not limited to, preferably 250 or more, more preferably 300.

A surface occupation ratio SR of the dimples (i.e., a ratio of the total area occupied by the dimples to the entire surface area of a virtual spherical surface of the golf ball obtained by supposing that no dimple exists on the golf ball surface) is preferably 70% or more, more preferably 75% or more, and yet more preferably 80% or more. An upper limit of the surface occupation ratio SR of the dimples is not particularly limited, and is preferably 99% or less. It is particularly preferable that at least three types of dimples with different sizes be arranged. With this configuration, the dimples can be uniformly arranged on the spherical surface of the golf ball without a gap.

A volume occupation ratio VR of the dimple (i.e., a ratio of the total volume of the dimples respectively formed in a portion downward from the plane surrounded by the edge of the dimple in relation to a virtual spherical volume of the golf ball obtained supposing that no dimple exists on the golf ball surface) is preferably 0.75% or more, more preferably 0.80% or more, and yet more preferably 1.1% or more. An upper limit of the volume occupation ratio VR of the dimples is preferably 1.5% or less, more preferably 1.4% or less.

The golf ball according to the present invention can be produced by metal molds. In preparing the metal molds, a method in which 3-dimensional computer-aided design (3DCAD) or computer-aided manufacturing (CAM) is used and the shape of the entire surface is directly and three-dimensionally carved on a reversing master mold and a method in which cavity portions of a molding die are directly and three-dimensionally carved can be used. By designing the metal molds so that the parting line of the metal mold is on the land portion of the golf ball surface, finishing (trimming) of the product can be easily performed. In order to uniformly develop the dimples on the spherical surface of the golf ball, it is preferable to use an arrangement method such as polyhedral arrangement such as icosahedral arrangement, dodecahedral arrangement, and octahedral arrangement, or a rotationally symmetrical arrangement such as a threefold symmetry arrangement and a fivefold symmetry arrangement.

EXAMPLE

For the dimples formed on the surface of the golf ball and the sectional shape of the dimples, two types of configurations, i.e., the configuration illustrated in FIGS. 1 and 2 and the configuration illustrated in FIGS. 3 and 4 were employed. For the configuration of the material of the golf ball, the following four types were employed to use different deformation amounts. For eight types of golf balls (Examples 1 to 8) each including a combination of the configurations mentioned above, the pressurized area was measured for the applied loads of 6864 N, 1961 N, 5883 N, 3922 N, and 7845 N, respectively, and the measured pressurized area was divided by the virtual plane area and the deformation amount, and then the resulting value was multiplied by 100 to obtain a value of the expression (PS/S/H×100). Tables 1 to 5 show the results for the respective loads.

Figure 5:
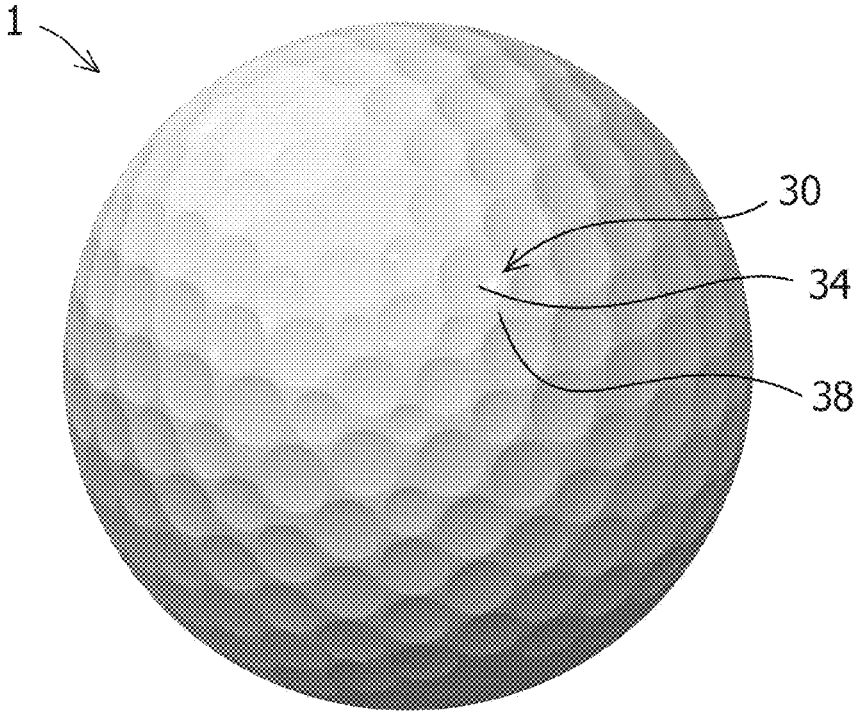
FIG. 5 is a perspective view which illustrates a Comparative Example of the golf ball.
Figure 6:
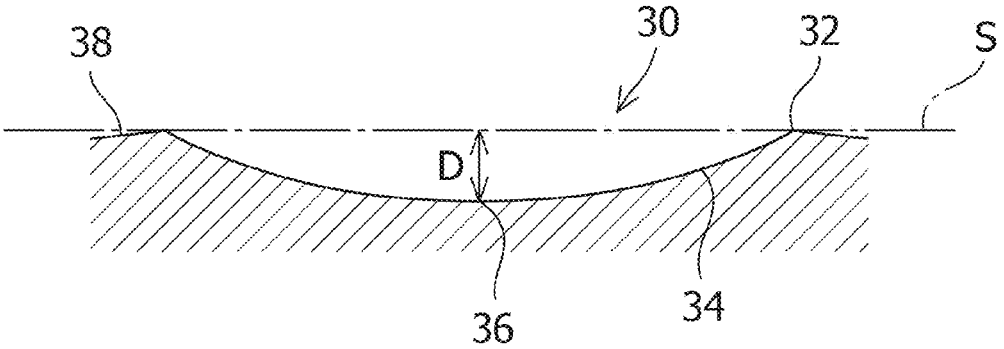
FIG. 6 is an enlarged cross-sectional view of one dimple of the golf ball illustrated in FIG. 5.

As Comparative Examples, the configuration illustrated in FIGS. 5 and 6 was employed, and three types of golf balls (Comparative Examples 1 to 3) were subjected to tests similar to the Examples of the present invention by using the same materials of the golf ball as those of the Examples. Tables 1 to 5 also show the results of the Comparative Examples.

Note that the diameter of the dimples and the number of the dimples are shown in Table 6. For all of the golf balls of the Examples and the Comparative Examples, six types of dimples with different diameters were arranged as shown in Table 6, and the same surface occupation ratio SR was employed. Among the six types of dimples with the different diameters, the configuration of the representative dimples with the diameter of 4.4 mm was as follows. For the dimples with the sectional shape illustrated in FIG. 2, the depth d at the center point was 0.029 mm, the depth D at the deepest point was 0.130 mm, the location from the outer periphery to the deepest point in relation to the distance from the outer periphery to the center point as 100 was 33, and the edge angle A1 was 3.5°. For the dimples with the sectional shape illustrated in FIG. 4, the depth d at the center point was 0.097 mm, the depth D at the deepest point was 0.131 mm, the location from the outer periphery to the deepest point in relation to the distance from the outer periphery to the center point as 100 was 39, the radius of curvature R was 0.5 mm, and the edge angle A2 was 10.5°. For the dimples of the Comparative Example with the sectional shape illustrated in FIG. 6, the depth D at a deepest point 36 was 0.150 mm.

Figure 7A:
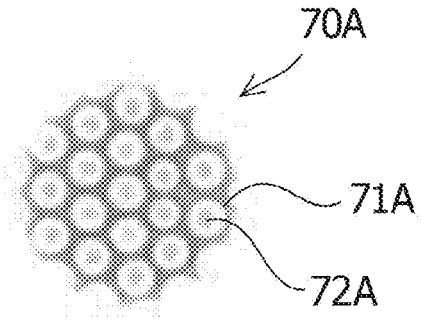
FIG. 7(*a*), FIG. 7(*b*), and FIG. 7(*c*) are views which illustrate an example for describing a method of determining the pressurized area of the golf ball according to the present invention.
Figure 7B:
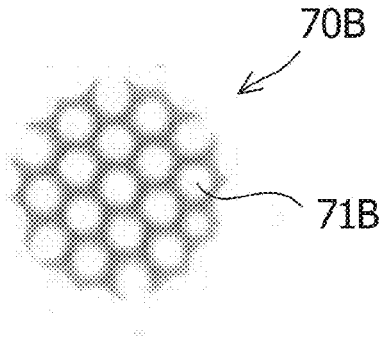
Figure 7C:
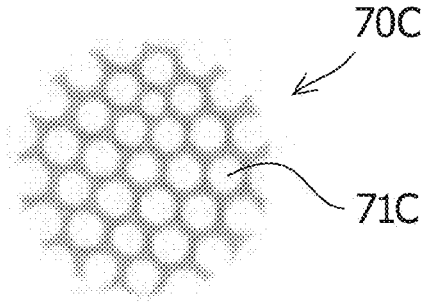
Figure 8A:
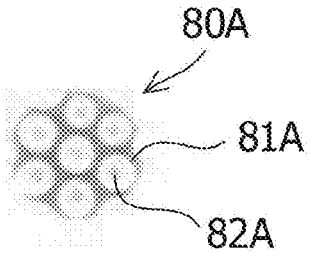
FIG. 8(*a*), FIG. 8(*b*), and FIG. 8(*c*) are views which illustrate another example for describing a method of determining the pressurized area of the golf ball according to the present invention.
Figure 8B:
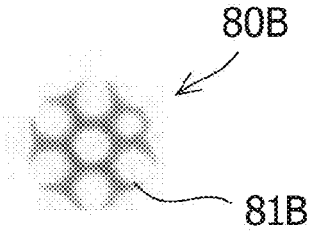
Figure 8C:
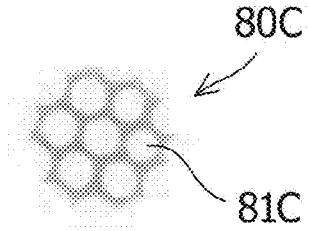

For the measurement method of the pressurized area PS of the golf ball, first, a pressure sensitive paper sheet (pressure measurement film for prescale medium pressure, a product of Fujifilm Corporation) is placed on a flat surface, then the golf balls of Examples 1 to 8 and Comparative Examples 1 to 3 are placed on the sheet, then the loads of 6864 N, 1961 N, 5883 N, 3922 N, and 7845 N are applied on the balls, respectively, by using Instron Model 4204 (a product of Instron Corp.), and then the total area of the portions of the pressure sensitive paper in which color is developed by the contact with the golf ball is measured. FIG. 7(*a*), FIG. 7(*b*), and FIG. 7(*c*) illustrate the pressure sensitive paper on which color was actually developed when the load of 6864 N was applied. FIG. 8(*a*), FIG. 8(*b*), and FIG. 8(*c*) illustrate the pressure sensitive paper on which color was actually developed when the load of 1961 N was applied. In FIG. 7(*a*), FIG. 7 (*b*), and FIG. 7(*c*) and FIG. 8(*a*), FIG. 8(*b*), and FIG. 8(*c*), FIG. 7(*a*) and FIG. 8(*a*) correspond to Example 1, FIG. 7(*b*) and FIG. 8(*b*) correspond to Comparative Example 1, and FIG. 7(*c*) and FIG. 8(*c*) correspond to Comparative Example 2. The area of the portion in which color was developed can be easily determined by using a prescale pressure image analysis system FPD-9270 (of Fujifilm Corporation). Note that the pressurized areas are results of measurement performed in one freely selected location on the golf ball.

TABLE 1

| | Example | | | | | | | | Comparative Example | | |
|---|---|---|---|---|---|---|---|---|---|---|---|
| 6864 N | 1 | 2 | 3 | 4 | 5 | 6 | 7 | 8 | 1 | 2 | 3 |
| Dimple configuration | FIGS. 1 and 2 | | | | FIGS. 3 and 4 | | | | FIGS. 5 and 6 | | |
| Material configuration | A | B | C | D | A | B | C | D | A | C | D |
| Virtual plane area S | 1432 | 1432 | 1432 | 1432 | 1432 | 1432 | 1432 | 1432 | 1432 | 1432 | 1432 |
| Deformation amount H | 2.5 | 2.0 | 3.2 | 4.0 | 2.5 | 2.0 | 3.2 | 4.0 | 2.5 | 3.2 | 4.0 |
| Pressurized area PS | 281 | 225 | 340 | 392 | 238 | 200 | 332 | 381 | 222 | 270 | 330 |
| PS/S/H × 100 | 7.84 | 7.85 | 7.41 | 6.84 | 6.64 | 6.98 | 7.24 | 6.65 | 6.20 | 5.89 | 5.76 |

TABLE 2

| | Example | | | | | | | | Comparative Example | | |
|---|---|---|---|---|---|---|---|---|---|---|---|
| 1961 N | 1 | 2 | 3 | 4 | 5 | 6 | 7 | 8 | 1 | 2 | 3 |
| Dimple configuration | FIGS. 1 and 2 | | | | FIGS. 3 and 4 | | | | FIGS. 5 and 6 | | |
| Material configuration | A | B | C | D | A | B | C | D | A | C | D |
| Virtual plane area S | 1432 | 1432 | 1432 | 1432 | 1432 | 1432 | 1432 | 1432 | 1432 | 1432 | 1432 |
| Deformation amount H | 2.5 | 2.0 | 3.2 | 4.0 | 2.5 | 2.0 | 3.2 | 4.0 | 2.5 | 3.2 | 4.0 |
| Pressurized area PS | 77 | 66 | 95 | 108 | 72 | 64 | 93 | 106 | 65 | 83 | 100 |
| PS/S/H × 100 | 2.15 | 2.30 | 2.07 | 1.89 | 2.01 | 2.23 | 2.03 | 1.85 | 1.82 | 1.81 | 1.75 |

TABLE 3

| | Example | | | | | | | | Comparative Example | | |
|---|---|---|---|---|---|---|---|---|---|---|---|
| 5883 N | 1 | 2 | 3 | 4 | 5 | 6 | 7 | 8 | 1 | 2 | 3 |
| Dimple configuration | FIGS. 1 and 2 | | | | FIGS. 3 and 4 | | | | FIGS. 5 and 6 | | |
| Material configuration | A | B | C | D | A | B | C | D | A | C | D |
| Virtual plane area S | 1432 | 1432 | 1432 | 1432 | 1432 | 1432 | 1432 | 1432 | 1432 | 1432 | 1432 |
| Deformation amount H | 2.5 | 2.0 | 3.2 | 4.0 | 2.5 | 2.0 | 3.2 | 4.0 | 2.5 | 3.2 | 4.0 |
| Pressurized area PS | 235 | 200 | 284 | 312 | 224 | 189 | 288 | 322 | 192 | 232 | 275 |
| PS/S/H × 100 | 6.56 | 6.98 | 6.20 | 5.45 | 6.26 | 6.60 | 6.28 | 5.62 | 5.36 | 5.06 | 4.80 |

TABLE 4

| | Example | | | | | | | | Comparative Example | | |
|---|---|---|---|---|---|---|---|---|---|---|---|
| 3922 N | 1 | 2 | 3 | 4 | 5 | 6 | 7 | 8 | 1 | 2 | 3 |
| Dimple configuration | FIGS. 1 and 2 | | | | FIGS. 3 and 4 | | | | FIGS. 5 and 6 | | |
| Material configuration | A | B | C | D | A | B | C | D | A | C | D |
| Virtual plane area S | 1432 | 1432 | 1432 | 1432 | 1432 | 1432 | 1432 | 1432 | 1432 | 1432 | 1432 |
| Deformation amount H | 2.5 | 2.0 | 3.2 | 4.0 | 2.5 | 2.0 | 3.2 | 4.0 | 2.5 | 3.2 | 4.0 |
| Pressurized area PS | 145 | 130 | 176 | 199 | 137 | 119 | 186 | 200 | 116 | 143 | 170 |
| PS/S/H × 100 | 4.05 | 4.54 | 3.84 | 3.47 | 3.83 | 4.16 | 4.06 | 3.49 | 3.24 | 3.12 | 2.97 |

TABLE 5

| | Example | | | | | | | | Comparative Example | | |
|---|---|---|---|---|---|---|---|---|---|---|---|
| 7845 N | 1 | 2 | 3 | 4 | 5 | 6 | 7 | 8 | 1 | 2 | 3 |
| Dimple configuration | FIGS. 1 and 2 | | | | FIGS. 3 and 4 | | | | FIGS. 5 and 6 | | |
| Material configuration | A | B | C | D | A | B | C | D | A | C | D |
| Virtual plane area S | 1432 | 1432 | 1432 | 1432 | 1432 | 1432 | 1432 | 1432 | 1432 | 1432 | 1432 |
| Deformation amount H | 2.5 | 2.0 | 3.2 | 4.0 | 2.5 | 2.0 | 3.2 | 4.0 | 2.5 | 3.2 | 4.0 |
| Pressurized area PS | 288 | 237 | 340 | 376 | 262 | 230 | 330 | 373 | 232 | 282 | 352 |
| PS/S/H × 100 | 8.04 | 8.28 | 7.42 | 6.56 | 7.32 | 8.03 | 7.20 | 6.51 | 6.48 | 6.15 | 6.15 |

TABLE 6

| No. | Number of dimples | Diameter (mm) | SR (%) |
|---|---|---|---|
| 1 | 12 | 4.6 | 81 |
| 2 | 234 | 4.4 | |
| 3 | 60 | 3.8 | |
| 4 | 6 | 3.5 | |
| 5 | 6 | 3.4 | |
| 6 | 12 | 2.6 | |
| Total | 330 | | |

For the production of the golf balls of the Examples and the Comparative Examples, four types of material configurations A to D were employed so as to use different deformation amounts. Table 7 shows the composition of the core used for the respective material configurations. Table 8 shows the composition of the intermediate layer. Table 9 shows the composition of the cover.

TABLE 7

| | | Composition of the core | | | |
|---|---|---|---|---|---|
| | | A | B | C | D |
| Polybutadiene A | | 80 | 80 | 80 | 80 |
| Polybutadiene B | | 20 | 20 | 20 | 20 |
| Zinc acrylate | | 45 | 50 | 38 | 33 |
| Superoxide | | 0.6 | 0.6 | 0.6 | 0.6 |
| Water | | 1.0 | 1.0 | 1.0 | 1.0 |
| Anti-aging agent | | 0.1 | 0.1 | 0.1 | 0.1 |
| Barium sulfate | | 15 | 13 | 17 | 19 |
| Zinc oxide | | 4.0 | 4.0 | 4.0 | 4.0 |
| Pentachlorothiophenol zinc salt | | 0.5 | 0.5 | 0.5 | 0.5 |
| Vulcanizing method | Temperature (° C.) | 155 | 155 | 155 | 155 |
| | Time (m) | 15 | 15 | 15 | 15 |

In Table 7, polybutadiene A in Table 7 is a product with the product name "BROI" of JSR Corporation, and polybutadiene B is a product with the product name "BR51" of JSR Corporation. The acrylic acid zinc is a product of NIPPON SHOKUBAI CO., LTD. The superoxide is dicumyl peroxide with a product name "PERCUMYL D" of NOF CORPORATION. The anti-aging agent is 2,2-methylenebis(4-methyl-6-butylphenol) with a product name "Nocrac NS-6" of OUCHI SHINKO CHEMICAL INDUSTRIAL CO., LTD. The barium sulfate is a product with the product name "Barite Powder #300" (of Hakusuitech Co., Ltd.). The zinc oxide is a product with the product name "ZINC OXIDE 3 TYPES" (a product of SAKAI CHEMICAL INDUSTRY CO., LTD.). The pentachlorothiophenol zinc salt is a product of Zhejiang Cho & Fu Chemical Co., Ltd.

TABLE 8

| | Composition of the intermediate layer | | | |
|---|---|---|---|---|
| | A | B | C | D |
| HPF1000 | 100 | 100 | 100 | 100 |

TABLE 9

| | Composition of the cover | | | |
|---|---|---|---|---|
| | A | B | C | D |
| Hi-milan 1605 | 50 | 50 | 50 | 50 |
| AN7329 | 50 | 50 | 50 | 50 |

In Table 8, "HPF1000" is an ionomer resin of Du Pont Kabushiki Kaisha. In Table 9, "Hi-milan 1605" is an ionomer resin of DU PONT-MITSUI POLYCHEMICALS. "AN7329" is an ethylene-methacrylic acid copolymer product name "Nucrel" (™) of DU PONT-MITSUI POLYCHEMICALS.

The amount of backspin (rpm) was measured for the samples of each golf ball of the Examples and the Comparative Examples. Tables 10 to 12 show the results. Note that in each Table, the results shown are results obtained by using the same deformation amount.

Note that the measurement of the amount of backspin (rpm) was carried out for a case in which a golf ball hitting robot with a driver W #1 mounted thereto was used and the samples were hit at a head speed of 50 m/s and at a head speed of 45 m/s at the hitting angle of 11° (HS50, HS45), a case in which the golf ball hitting robot with an iron #6 mounted thereto was used and the samples were hit at a head speed of 40 m/s at the hitting angle of 17°, (IRON #6), and a case in which the golf ball hitting robot with a sand wedge mounted thereto was used and the samples were hit at a head speed of 20 m/s at the hitting angle of 17° (AP).

TABLE 10

| | Deformation amount = 2.5 | | |
|---|---|---|---|
| | Example 1 | Example 5 | Comparative Example 1 |
| HS50 | 2540 | 2600 | 2790 |
| HS45 | 2710 | 2800 | 2910 |
| IRON #6 | 5480 | 5570 | 5840 |
| AP | 6250 | 6150 | 5630 |

TABLE 11

| | Deformation amount = 3.2 | | |
|---|---|---|---|
| | Example 3 | Example 7 | Comparative Example 2 |
| HS50 | 2420 | 2500 | 2690 |
| HS45 | 2600 | 2690 | 2830 |
| IRON #6 | 5360 | 5450 | 5750 |
| AP | 6150 | 6040 | 5500 |

TABLE 12

| | Deformation amount = 4.0 | | |
|---|---|---|---|
| | Example 4 | Example 8 | Comparative Example 3 |
| HS50 | 2300 | 2340 | 2640 |
| HS45 | 2430 | 2550 | 2690 |
| IRON #6 | 5220 | 5340 | 5600 |
| AP | 6000 | 5890 | 5450 |

As shown in Tables 10 to 12, in the cases in which the deformation amount H (ball hardness) was the same, the amount of backspin of the golf balls of Examples 1, 3, 4, 5, 7, and 8, for which the dimples had been configured so as to obtain a predetermined value or more for the value of the expression PS/S/H×100 was decreased in shots taken by using the driver and the iron #6 and the amount of backspin was increased on approach shots compared with the golf balls of Comparative Examples 1 to 3 for any of the deformation amounts described above.

What is claimed is:

1. A golf ball comprising a plurality of dimples on a surface thereof, wherein a bottom of the dimple has an entirely curved shape protruding toward an outside of the golf ball, wherein a depth d of a highest point of a protruding portion of the bottom of the dimple is a perpendicular distance from a height of a line S connecting both ends of an outer periphery of the dimple, the depth d having a range of 0.020 to 0.080 mm, wherein a depth D of a deepest point of the bottom of the dimple is a perpendicular distance from the height of the line S, the depth D being deeper than the depth d by at least 0.100 mm, wherein the golf ball satisfies expression (1):

$$PS_7/S/H\times100\geq6.25\ (\mathrm{mm}^{-1}) \quad (1),$$

wherein

H is a deformation amount (mm), which is an amount of deformation obtained when loads from an initial load of 98 N to a final load of 1275 N are applied to the golf ball;

S is a virtual plane area ($mm^2$), which is an area of a circle of a cross section along a diameter of the golf ball determined supposing that no dimple exists on the surface of the golf ball; and $PS_7$ is a pressurized area ($mm^2$), which is an area of the golf ball contacting a plane when a load of 6864 N is applied to the golf ball, wherein the deformation amount H has a range of 1.5 to 5.0 mm, wherein the curved shape of the bottom of the dimple has an edge angle A1 to the center protruding portion of 2 to 15 degrees, the edge angle A1 being an angle formed between a tangent line passing through the depth d on the bottom curve and a point deeper than the depth d by 10% and the line S, wherein a volume occupation ratio VR of the dimple is 0.75% to 1.5%, the volume occupation ratio VR being a ratio of the total volume of the dimples respectively formed in a portion downward from the plane surrounded by the edge of the dimple in relation to a virtual spherical volume of the golf ball obtained supposing that no dimple exists on the golf ball surface.

2. The golf ball according to claim 1, wherein the golf ball further satisfies expression (2):

$$PS_2/S/H\times100\geq1.85\ (\mathrm{mm}^{-1}) \quad (2),$$

wherein $PS_2$ is a pressurized area ($mm^2$), which is an area of the golf ball contacting a plane when a load of 1961 N is applied to the golf ball.

3. The golf ball according to claim 1, wherein the golf ball further satisfies expression (3):

$$PS_6/S/H\times100\geq5.40\ (\mathrm{mm}^{-1}) \quad (3),$$

wherein $PS_6$ is a pressurized area ($mm^2$), which is an area of the golf ball contacting a plane when a load of 5883 N is applied to the golf ball.

4. The golf ball according to claim 1, wherein the golf ball further satisfies expression (4):

$$PS_4/S/H\times100\geq3.30\ (\mathrm{mm}^{-1}) \quad (4),$$

wherein $PS_4$ is a pressurized area ($mm^2$), which is an area of the golf ball contacting a plane when a load of 3922 N is applied to the golf ball.

5. The golf ball according to claim 1, wherein the golf ball further satisfies expression (5):

$$PS_8/S/H\times100\geq6.50\ (\mathrm{mm}^{-1}) \quad (5),$$

wherein $PS_8$ is a pressurized area ($mm^2$), which is an area of the golf ball contacting a plane when a load of 7845 N is applied to the golf ball.

6. A golf ball comprising a plurality of dimples on a surface thereof, wherein a bottom of the dimple has an entirely curved shape protruding toward an outside of the golf ball, wherein a depth d of a highest point of a protruding portion of the bottom of the dimple is a perpendicular distance from a height of a line S connecting both ends of an outer periphery of the dimple, the depth d having a range of 0.020 to 0.080 mm, wherein a depth D of a deepest point of the bottom of the dimple is a perpendicular distance from the height of the line S, the depth D being deeper than the depth d by at least 0.100 mm, wherein the golf ball satisfies expression (2):

$$PS_2/S/H\times100\geq1.85\ (\mathrm{mm}^{-1}) \quad (2),$$

wherein

H is a deformation amount (mm), which is an amount of deformation obtained when loads from an initial load of 98 N to a final load of 1275 N are applied to the golf ball;

S is a virtual plane area ($mm^2$), which is an area of a circle of a cross section along a diameter of the golf ball determined supposing that no dimple exists on the surface of the golf ball; and $PS_2$ is a pressurized area ($mm^2$), which is an area of the golf ball contacting a plane when a load of 1961 N is applied to the golf ball, wherein the deformation amount H has a range of 1.5 to 5.0 mm, wherein the curved shape of the bottom of the dimple has an edge angle A1 to the center protruding portion of 2 to 15 degrees, the edge angle A1 being an angle formed between a tangent line passing through the depth d on the bottom curve and a point deeper than the depth d by 10% and the line S, wherein a volume occupation ratio VR of the dimple is 0.75% to 1.5%, the volume occupation ratio VR being a ratio of the total volume of the dimples respectively formed in a portion downward from the plane surrounded by the edge of the dimple in relation to a virtual spherical volume of the golf ball obtained supposing that no dimple exists on the golf ball surface.

7. A golf ball comprising a plurality of dimples on a surface thereof, wherein a bottom of the dimple has an entirely curved shape protruding toward an outside of the golf ball, wherein a depth d of a highest point of a protruding portion of the bottom of the dimple is a perpendicular distance from a height of a line S connecting both ends of an outer periphery of the dimple, the depth d having a range of 0.020 to 0.080 mm, wherein a depth D of a deepest point of the bottom of the dimple is a perpendicular distance from the height of the line S, the depth D being deeper than the depth d by at least 0.100 mm, wherein the golf ball satisfies expression (3):

$$PS_6/S/H\times100\geq5.40\ (\mathrm{mm}^{-1}) \quad (3),$$

wherein

H is a deformation amount (mm), which is an amount of deformation obtained when loads from an initial load of 98 N to a final load of 1275 N are applied to the golf ball;

S is a virtual plane area ($mm^2$), which is an area of a circle of a cross section along a diameter of the golf ball determined supposing that no dimple exists on the surface of the golf ball; and $PS_6$ is a pressurized area ($mm^2$), which is an area of the golf ball contacting a plane when a load of 5883 N is applied to the golf ball, wherein the deformation amount H has a range of 1.5 to 5.0 mm, wherein the curved shape of the bottom of the dimple has an edge angle A1 to the center protruding portion of 2 to 15 degrees, the edge angle A1 being an angle formed between a tangent line passing through the depth d on the bottom curve and a point deeper than the depth d by 10% and the line S, wherein a volume occupation ratio VR of the dimple is 0.75% to 1.5%, the volume occupation ratio VR being a ratio of the total volume of the dimples respectively formed in a portion downward from the plane surrounded by the edge of the dimple in relation to a virtual spherical volume of the golf ball obtained supposing that no dimple exists on the golf ball surface.

8. A golf ball comprising a plurality of dimples on a surface thereof, wherein a bottom of the dimple has an entirely curved shape protruding toward an outside of the golf ball, wherein a depth d of a highest point of a protruding portion of the bottom of the dimple is a perpendicular distance from a height of a line S connecting both ends of an outer periphery of the dimple, the depth d having a range of 0.020 to 0.080 mm, wherein a depth D of a deepest point of the bottom of the dimple is a perpendicular distance from the height of the line S, the depth D being deeper than the depth d by at least 0.100 mm, wherein the golf ball satisfies expression (4):

$$PS_4/S/H\times100\geq3.30\ (\mathrm{mm}^{-1}) \quad (4)$$

wherein

H is a deformation amount (mm), which is an amount of deformation obtained when loads from an initial load of 98 N to a final load of 1275 N are applied to the golf ball;

S is a virtual plane area ($mm^2$), which is an area of a circle of a cross section along a diameter of the golf ball determined supposing that no dimple exists on the surface of the golf ball; and $PS_4$ is a pressurized area ($mm^2$), which is an area of the golf ball contacting a plane when a load of 3922 N is applied to the golf ball, wherein the deformation amount H has a range of 1.5 to 5.0 mm, wherein the curved shape of the bottom of the dimple has an edge angle A1 to the center protruding portion of 2 to 15 degrees, the edge angle A1 being an angle formed between a tangent line passing through the depth d on the bottom curve and a point deeper than the depth d by 10% and the line S, wherein a volume occupation ratio VR of the dimple is 0.75% to 1.5%, the volume occupation ratio VR being a ratio of the total volume of the dimples respectively formed in a portion downward from the plane surrounded by the edge of the dimple in relation to a virtual spherical volume of the golf ball obtained supposing that no dimple exists on the golf ball surface.

9. A golf ball comprising a plurality of dimples on a surface thereof, wherein a bottom of the dimple has an entirely curved shape protruding toward an outside of the golf ball, wherein a depth d of a highest point of a protruding portion of the bottom of the dimple is a perpendicular distance from a height of a line S connecting both ends of an outer periphery of the dimple, the depth d having a range of 0.020 to 0.080 mm, wherein a depth D of a deepest point of the bottom of the dimple is a perpendicular distance from the height of the line S, the depth D being deeper than the depth d by at least 0.100 mm, wherein the golf ball satisfies expression (5):

$$PS_8/S/H\times100\geq6.50\ (\mathrm{mm}^{-1}) \quad (5)$$

wherein

H is a deformation amount (mm), which is an amount of deformation obtained when loads from an initial load of 98 N to a final load of 1275 N are applied to the golf ball;

S is a virtual plane area ($mm^2$), which is an area of a circle of a cross section along a diameter of the golf ball determined supposing that no dimple exists on the surface of the golf ball; and $PS_8$ is a pressurized area ($mm^2$), which is an area of the golf ball contacting a plane when a load of 7845 N is applied to the golf ball, wherein the deformation amount H has a range of 1.5 to 5.0 mm, wherein the curved shape of the bottom of the dimple has an edge angle A1 to the center protruding portion of 2 to 15 degrees, the edge angle A1 being an angle formed between a tangent line passing through the depth d on the bottom curve and a point deeper than the depth d by 10% and the line S, wherein a volume occupation ratio VR of the dimple is 0.75% to 1.5%, the volume occupation ratio VR being a ratio of the total volume of the dimples respectively formed in a portion downward from the plane surrounded by the edge of the dimple in relation to a virtual spherical volume of the golf ball obtained supposing that no dimple exists on the golf ball surface.

10. A golf ball comprising a plurality of dimples on a surface thereof, wherein a bottom of the dimple has a curved shape protruding toward an outside of the golf ball and a flat shape in a central portion thereof, an outer periphery of the flat center portion being chamfered so that a radius of curvature R thereof is at least 0.4 mm, wherein a depth d of a highest point of a protruding portion of the bottom of the dimple is a perpendicular distance from a height of a line S connecting both ends of an outer periphery of the dimple, the depth d having a range of 0.020 to 0.080 mm, wherein a depth D of a deepest point of the bottom of the dimple is a perpendicular distance from the height of the line S, the depth D being deeper than the depth d by at least 0.100 mm, wherein the golf ball satisfies expression (1):

$$PS_7/S/H\times100\geq6.25\ (\mathrm{mm}^{-1}) \quad (1),$$

wherein

H is a deformation amount (mm), which is an amount of deformation obtained when loads from an initial load of 98 N to a final load of 1275 N are applied to the golf ball;

S is a virtual plane area ($mm^2$), which is an area of a circle of a cross section along a diameter of the golf ball determined supposing that no dimple exists on the surface of the golf ball; and $PS_7$ is a pressurized area ($mm^2$), which is an area of the golf ball contacting a plane when a load of 6864 N is applied to the golf ball, wherein the deformation amount H has a range of 1.5 to 5.0 mm, wherein the curved shape of the bottom of the dimple has an edge angle A2 to the center protruding portion of 2 to 15 degrees, the edge angle A2 being an angle formed between a tangent line passing through the depth d on the bottom curve and a point deeper than the depth d by 10% and the line S, wherein a volume occupation ratio VR of the dimple is 0.75% to 1.5%, the volume occupation ratio VR being a ratio of the total volume of the dimples respectively formed in a portion downward from the plane surrounded by the edge of the dimple in relation to a virtual spherical volume of the golf ball obtained supposing that no dimple exists on the golf ball surface.

11. The golf ball according to claim 10, wherein the golf ball further satisfies expression (2):

$$PS_2/S/H\times100\geq1.85\ (\mathrm{mm}^{-1}) \quad (2),$$

wherein $PS_2$ is a pressurized area ($mm^2$), which is an area of the golf ball contacting a plane when a load of 1961 N is applied to the golf ball.

12. The golf ball according to claim 10, wherein the golf ball further satisfies expression (3):

$$PS_6/S/H\times100\geq5.40\ (\mathrm{mm}^{-1}) \quad (3),$$

wherein $PS_6$ is a pressurized area ($mm^2$), which is an area of the golf ball contacting a plane when a load of 5883 N is applied to the golf ball.

13. The golf ball according to claim 10, wherein the golf ball further satisfies expression (4):

$$PS_4/S/H\times100\geq3.30\ (\mathrm{mm}^{-1}) \quad (4),$$

wherein $PS_4$ is a pressurized area ($mm^2$), which is an area of the golf ball contacting a plane when a load of 3922 N is applied to the golf ball.

14. The golf ball according to claim 10, wherein the golf ball further satisfies expression (5):

$$PS_8/S/H\times100\geq6.50\ (\mathrm{mm}^{-1}) \quad (5),$$

wherein $PS_8$ is a pressurized area ($mm^2$), which is an area of the golf ball contacting a plane when a load of 7845 N is applied to the golf ball.

15. A golf ball comprising a plurality of dimples on a surface thereof, wherein a bottom of the dimple has a curved shape protruding toward an outside of the golf ball and a flat shape in a central portion thereof, an outer periphery of the flat center portion being chamfered so that a radius of curvature R thereof is at least 0.4 mm, wherein a depth d of a highest point of a protruding portion of the bottom of the dimple is a perpendicular distance from a height of a line S connecting both ends of an outer periphery of the dimple, the depth d having a range of 0.020 to 0.080 mm, wherein a depth D of a deepest point of the bottom of the dimple is a perpendicular distance from the height of the line S, the depth D being deeper than the depth d by at least 0.100 mm, wherein the golf ball satisfies expression (2):

$$PS_2/S/H\times100\geq1.85\ (\mathrm{mm}^{-1}) \quad (2),$$

wherein

H is a deformation amount (mm), which is an amount of deformation obtained when loads from an initial load of 98 N to a final load of 1275 N are applied to the golf ball;

S is a virtual plane area ($mm^2$), which is an area of a circle of a cross section along a diameter of the golf ball determined supposing that no dimple exists on the surface of the golf ball; and $PS_2$ is a pressurized area ($mm^2$), which is an area of the golf ball contacting a plane when a load of 1961 N is applied to the golf ball, wherein the deformation amount H has a range of 1.5 to 5.0 mm, wherein the curved shape of the bottom of the dimple has an edge angle A2 to the center protruding portion of 2 to 15 degrees, the edge angle A2 being an angle formed between a tangent line passing through the depth d on the bottom curve and a point deeper than the depth d by 10% and the line S, wherein a volume occupation ratio VR of the dimple is 0.75% to 1.5%, the volume occupation ratio VR being a ratio of the total volume of the dimples respectively formed in a portion downward from the plane surrounded by the edge of the dimple in relation to a virtual spherical volume of the golf ball obtained supposing that no dimple exists on the golf ball surface.

16. A golf ball comprising a plurality of dimples on a surface thereof, wherein a bottom of the dimple has a curved shape protruding toward an outside of the golf ball and a flat shape in a central portion thereof, an outer periphery of the flat center portion being chamfered so that a radius of curvature R thereof is at least 0.4 mm, wherein a depth d of a highest point of a protruding portion of the bottom of the dimple is a perpendicular distance from a height of a line S connecting both ends of an outer periphery of the dimple, the depth d having a range of 0.020 to 0.080 mm, wherein a depth D of a deepest point of the bottom of the dimple is a perpendicular distance from the height of the line S, the depth D being deeper than the depth d by at least 0.100 mm, wherein the golf ball satisfies expression (3):

$$PS_6/S/H\times100\geq5.40\ (\mathrm{mm}^{-1}) \quad (3),$$

wherein

H is a deformation amount (mm), which is an amount of deformation obtained when loads from an initial load of 98 N to a final load of 1275 N are applied to the golf ball;

S is a virtual plane area ($mm^2$), which is an area of a circle of a cross section along a diameter of the golf ball determined supposing that no dimple exists on the surface of the golf ball; and $PS_6$ is a pressurized area ($mm^2$), which is an area of the golf ball contacting a plane when a load of 5883 N is applied to the golf ball, wherein the deformation amount H has a range of 1.5 to 5.0 mm, wherein the curved shape of the bottom of the dimple has an edge angle A2 to the center protruding portion of 2 to 15 degrees, the edge angle A2 being an angle formed between a tangent line passing through the depth d on the bottom curve and a point deeper than the depth d by 10% and the line S, wherein a volume occupation ratio VR of the dimple is 0.75% to 1.5%, the volume occupation ratio VR being a ratio of the total volume of the dimples respectively formed in a portion downward from the plane surrounded by the edge of the dimple in relation to a virtual spherical volume of the golf ball obtained supposing that no dimple exists on the golf ball surface.

17. A golf ball comprising a plurality of dimples on a surface thereof, wherein a bottom of the dimple has a curved shape protruding toward an outside of the golf ball and a flat shape in a central portion thereof, an outer periphery of the flat center portion being chamfered so that a radius of curvature R thereof is at least 0.4 mm, wherein a depth d of a highest point of a protruding portion of the bottom of the dimple is a perpendicular distance from a height of a line S connecting both ends of an outer periphery of the dimple, the depth d having a range of 0.020 to 0.080 mm, wherein a depth D of a deepest point of the bottom of the dimple is a perpendicular distance from the height of the line S, the depth D being deeper than the depth d by at least 0.100 mm, wherein the golf ball satisfies expression (4):

$$PS_4/S/H\times100\geq3.30\ (\mathrm{mm}^{-1}) \quad (4)$$

wherein

H is a deformation amount (mm), which is an amount of deformation obtained when loads from an initial load of 98 N to a final load of 1275 N are applied to the golf ball;

S is a virtual plane area ($mm^2$), which is an area of a circle of a cross section along a diameter of the golf ball determined supposing that no dimple exists on the surface of the golf ball; and $PS_4$ is a pressurized area ($mm^2$), which is an area of the golf ball contacting a plane when a load of 3922 N is applied to the golf ball, wherein the deformation amount H has a range of 1.5 to 5.0 mm, wherein the curved shape of the bottom of the dimple has an edge angle A2 to the center protruding portion of 2 to 15 degrees, the edge angle A2 being an angle formed between a tangent line passing through the depth d on the bottom curve and a point deeper than the depth d by 10% and the line S, wherein a volume occupation ratio VR of the dimple is 0.75% to 1.5%, the volume occupation ratio VR being a ratio of the total volume of the dimples respectively formed in a portion downward from the plane surrounded by the edge of the dimple in relation to a virtual spherical volume of the golf ball obtained supposing that no dimple exists on the golf ball surface.

18. A golf ball comprising a plurality of dimples on a surface thereof, wherein a bottom of the dimple has a curved shape protruding toward an outside of the golf ball and a flat shape in a central portion thereof, an outer periphery of the flat center portion being chamfered so that a radius of curvature R thereof is at least 0.4 mm, wherein a depth d of a highest point of a protruding portion of the bottom of the dimple is a perpendicular distance from a height of a line S connecting both ends of an outer periphery of the dimple, the depth d having a range of 0.020 to 0.080 mm, wherein a depth D of a deepest point of the bottom of the dimple is a perpendicular distance from the height of the line S, the depth D being deeper than the depth d by at least 0.100 mm, wherein the golf ball satisfies expression (5):

$$PS_8/S/H\times100\geq6.50\ (\mathrm{mm}^{-1}) \quad (5)$$

wherein

H is a deformation amount (mm), which is an amount of deformation obtained when loads from an initial load of 98 N to a final load of 1275 N are applied to the golf ball;

S is a virtual plane area ($mm^2$), which is an area of a circle of a cross section along a diameter of the golf ball determined supposing that no dimple exists on the surface of the golf ball; and $PS_8$ is a pressurized area ($mm^2$), which is an area of the golf ball contacting a plane when a load of 7845 N is applied to the golf ball, wherein the deformation amount H has a range of 1.5 to 5.0 mm, wherein the curved shape of the bottom of the dimple has an edge angle A2 to the center protruding portion of 2 to 15 degrees, the edge angle A2 being an angle formed between a tangent line passing through the depth d on the bottom curve and a point deeper than the depth d by 10% and the line S, wherein a volume occupation ratio VR of the dimple is 0.75% to 1.5%, the volume occupation ratio VR being a ratio of the total volume of the dimples respectively formed in a portion downward from the plane surrounded by the edge of the dimple in relation to a virtual spherical volume of the golf ball obtained supposing that no dimple exists on the golf ball surface.

* * * * *